US007217196B2

(12) United States Patent
Cestro

(10) Patent No.: US 7,217,196 B2
(45) Date of Patent: May 15, 2007

(54) SPRING ACTIVATED POOL CUE DESIGNED FOR CONVENIENT STORAGE

(76) Inventor: Dominick Cestro, 4216 N. 85th Dr., Phx, AZ (US) 85037

( * ) Notice: Subject to any disclaimer, the term of this patent is extended or adjusted under 35 U.S.C. 154(b) by 0 days.

(21) Appl. No.: 10/709,066

(22) Filed: Apr. 9, 2004

(65) Prior Publication Data

US 2004/0248660 A1 Dec. 9, 2004

Related U.S. Application Data

(60) Provisional application No. 60/320,147, filed on Apr. 25, 2003.

(30) Foreign Application Priority Data

Oct. 14, 2003 (WO) ..... PCT/IB2003/003735

(51) Int. Cl.
*A63D 15/08* (2006.01)

(52) U.S. Cl. ..... 473/45

(58) Field of Classification Search ..... 473/44–51
See application file for complete search history.

(56) References Cited

U.S. PATENT DOCUMENTS

| | | | | | |
|---|---|---|---|---|---|
| 673,693 | A | | 5/1901 | Beaufils | |
| 673,753 | A | | 5/1901 | Beaufils | |
| 942,486 | A | * | 12/1909 | Dall | 473/45 |
| 1,182,530 | A | | 5/1916 | Duane | |
| 1,604,023 | A | | 10/1926 | Coyle | |
| 3,447,805 | A | | 6/1969 | Beley | |
| 3,495,828 | A | | 2/1970 | Mizgaza | |
| 3,711,093 | A | * | 1/1973 | Evans | 473/45 |
| 3,897,061 | A | | 7/1975 | Gratten | |
| 4,134,588 | A | | 1/1979 | DeLuzio | |
| 4,231,574 | A | * | 11/1980 | Williams | 473/44 |
| 4,526,370 | A | | 7/1985 | Mortellacci | |
| 4,634,123 | A | | 1/1987 | Cowan | |
| 4,718,671 | A | | 1/1988 | Desmond | |
| 4,949,964 | A | | 8/1990 | Jolly | |
| 5,299,983 | A | | 4/1994 | Pfrost | |
| 5,411,441 | A | | 5/1995 | Detka | |
| 5,628,691 | A | | 5/1997 | Shaner | |
| 6,348,006 | B2 | | 2/2002 | Costain et al. | |

* cited by examiner

*Primary Examiner*—Mark S. Graham

(57) ABSTRACT

A spring activated pool cue is disclosed for use in games such as billiards. The device has also been designed to be taken apart for convenient storage and transport.

8 Claims, 1 Drawing Sheet

SPRING ACTIVATED POOL CUE DESIGNED FOR CONVENIENT STORAGE

CROSS REFERENCE TO RELATED APPLICATIONS

This application claims the benefit of U.S. Provisional Patent Application Ser. No. 60/320,147 filed on Apr. 25, 2003. The entire disclosure is incorporated by reference herein.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed toward pool cues used in games that are played on a billiard table such as pool, billiards, snooker, and the like. The pool cue of this invention is a hollow shaft wherein a mechanical spring loaded mechanism is activated inside the cue so that the cue tip is projected outward to strike a billiard ball. The striking force may be varied by an adjustment at the end of the cue. The design of the cue looks very similar to a standard pool cue that is manually struck against the billiard ball. The cue is designed to be disassembled for convenient storage and transport.

(2) Description of Related Art

U.S. Pat. Nos. 6,348,006, 5,628,691, 4,949,964, and 4,718,671 all disclose various methods of creating a variable length cue stick. The methods in these patents include screw assembly and telescoping. Various locking methods are disclosed to fix the telescoping length.

U.S. Pat. No. 5,411,441 discloses a cue tip that is spring loaded in connection with a silicone encasement. The goal is to provide additional momentum to the ball when struck.

U.S. Pat. No. 5,299,983 discloses a spring activated cue using a ratchet and pawl. The invention is overly complicated in order to move the cue tip forward and backward, and most of the cue length moves relative to the end which contains the spring actuation mechanism. This makes it difficult for an operator to hold and aim correctly.

U.S. Pat. No. 4,634,123 discloses a spring activated cue using a saw tooth ratchet mechanism that locks the cue tip inside the hollow cue shaft. It is difficult for the operator to know exactly where the cue tip will strike the ball as the cue tip is recessed within the hollow cue.

U.S. Pat. No. 4,526,370 discloses a spring activated cue designed with two pieces: a moving portion and a fixed portion. The moving portion is difficult for the operator to hold steady and strike on the desired ball spot when suddenly activated.

U.S. Pat. No. 4,134,588 discloses a spring activated cue tip for a shorter cue length with an awkward push button and method to vary the striking force. The striking force is restricted to a few select forces and is not continuously adjustable.

U.S. Pat. No. 3,447,805 discloses a spring activated cue. Similar to U.S. Pat. No. 4,526,370 the moving portion is difficult for the operator to hold steady and strike on the desired ball spot when activated. Also the striking force is restricted to a few select forces and is not continuously adjustable.

U.S. Pat. No. 1,604,023 discloses a spring activated cue tip with a moving stock piece at the end of the cue. When activated, the device is designed for the cue tip to strike the ball and return to the latched position. To do this, a stock piece at the other end pops out. The end stock piece is then pressed inward to reset the device. There is additional internal undesirable movement that disturbs the aim of the operator and makes the striking force less predictable.

U.S. Pat. No. 1,182,530 discloses a spring activated cue tip that includes two springs and a gun trigger type of release mechanism. A primary forcing shaft strikes a secondary shaft which is attached to the cue tip. The energy needed to activate the device is set by a sliding collar. The collar is troublesome and the operator must remember to slide it to the proper forward position or the device activation will impact the collar which is liable to hurt the operator's hand. The gun trigger is an unnatural and undesirable way of holding a cue, making the cue awkward to aim.

U.S. Pat. Nos. 673,753 and 673,693 both disclose a spring activated cue. Similar to U.S. Pat. No. 4,526,370, the suddenly moving portion is difficult for the operator to hold steady and strike on the desired ball spot when activated. Two springs are used to create the striking energy and also retract the moving portion partially into the fixed portion.

In addition, in U.S. Pat. Nos. 4,634,123, 4,526,370, 4,134,588, and 3,447,805 the adjusting mechanism provides a higher striking force with the longer ball striking movement which is undesirable as a longer cue may contact other balls causing a game violation.

None of the above disclosed spring activated devices provide for operator convenience in traveling or storage. There has been no consideration for convenient disassembly for a more convenient length suitable for a carrying or storage nor has there been consideration for economic and simplified manufacturability.

BRIEF SUMMARY OF THE INVENTION

This invention is directed toward a piece pool cue that is designed to strike the cue ball with a cue tip that is spring activated and also overcomes the problems just mentioned with similar devices. The device has also been specifically designed to be taken apart for storage, transport, and easy repair.

BRIEF DESCRIPTION OF THE SEVERAL VIEWS OF THE DRAWING(S)

DETAILED DESCRIPTION OF THE INVENTION

Figure 1:
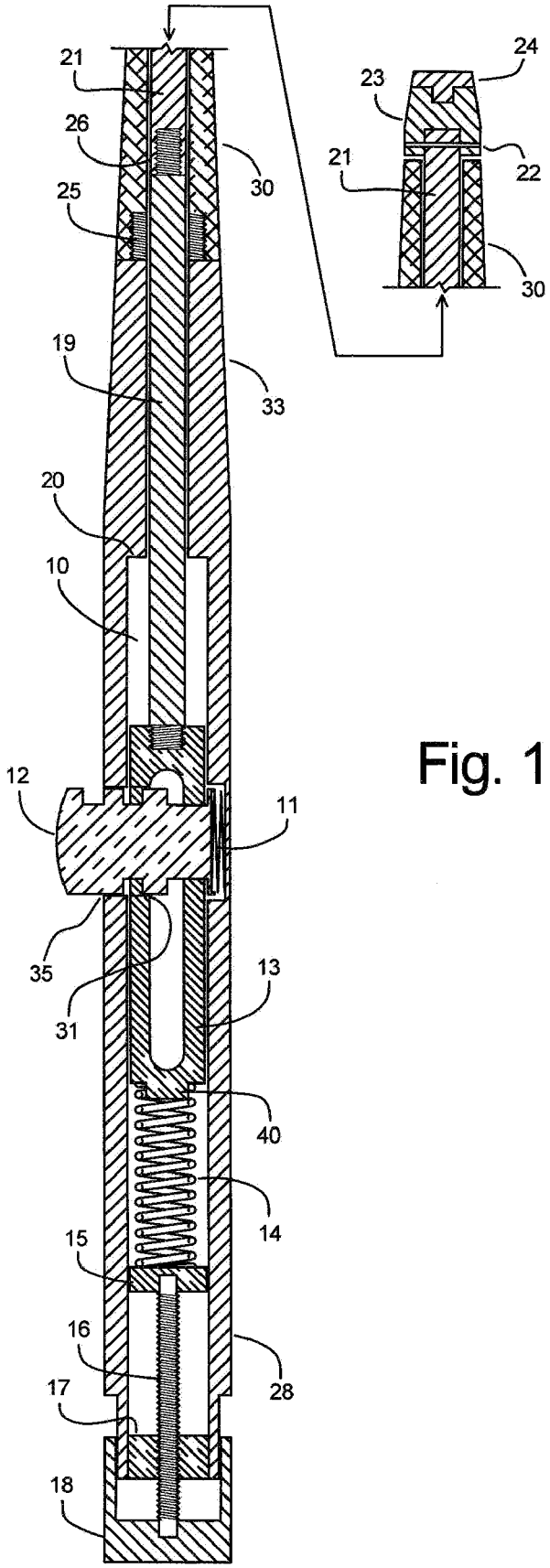
FIG. 1 is a general arrangement of the spring activated pool cue as a cross section.

FIG. 1 shows a general arrangement cross section of the pool cue as conceived in this invention. To aid in understanding this general arrangement, the pool cue is made up of the following items.

No. Description
10 Release mechanism cavity
11 Trigger release button spring
12 Trigger release button
13 Release cylinder
14 Barrel spring
15 End plate
16 Threaded rod
17 Threaded bushing
18 Tension adjustment coupler
19 Rear impact rod
20 Stop edge
21 Front impact rod
22 Pin
23 Machined tip
24 End impact tip
25 Threaded connection for cue barrels
26 Threaded connection for impact rods
28 Rear cue barrel
30 Front cue barrel
31 Contact point
33 Barrel taper
35 Drilled opening in rear cue barrel
40 Machined recess The cue is made up of two elongated barrels, a front cue barrel 30 and a rear cue barrel 28. Both barrels may be made from materials such as aluminum, titanium, graphite, and wood. A preferred embodiment is to begin with a solid aluminum dowel or billet. The overall length of the cue can vary from a typical four and one half feet long to any length specified by a prospective owner. The barrel outside diameter is preferably 1.25 inches. The barrels are preferably made by drilling length wise with a gun drill bit to bore ⅛ inch hole or a 3/16 inch hole as illustrated to allow the front impact rod 21 and rear impact rod 19 to freely move. A taper 33 in machined on the outside diameter the front cue barrel 30 and rear cue barrel 28 to match existing cue designs. The outside of the barrels can be given a high quality machined or polished finish.

It should be noted that FIG. 1 is not drawn to scale. The length is shortened for the sake of showing the important features of the invention.

The front cue barrel 30 and rear cue barrel 28 are carefully machined so that they can be screwed together by male and female threads 25 near the middle of the overall cue length. The machining must be done carefully to ensure that the mating surfaces keep the overall cue assembly straight.

The rear cue barrel 28 is also drilled or machined out, preferably to ⅝ inches in diameter and 4 to 6 inches deep, to allow the barrel spring 14 and release mechanism assembly to be inserted into the cue. A stop edge 20 illustrates where the diameter changes. The end diameter of the rear cue barrel 28 is also machined to allow room for the tension adjustment coupler 18 to be assembled.

The rear cue barrel 28 is also drilled out 35, preferably to ⅜ inches in diameter and just deep enough to allow the trigger release button 12 and the trigger release button spring 11 to be inserted. A spring release mechanism cavity 10 is created inside the rear cue barrel 28 by the machining and drilling.

The barrel spring 14 and release mechanism assembly is designed to provide for continuously variable energy storage in the barrel spring and provide for a fixed stroke length for striking a billiard ball.

The energy stored in the barrel spring 14 is adjusted by an assembly of four parts. A threaded rod 16 is firmly fixed to a threaded tension coupler 18 and an end plate 15 so that they all rotate together. A threaded bushing 17 is fixed to the end of the rear cue barrel 28 by a pin or other means. When the tension adjustment coupler is turned, the threaded rod 16 turns inside the threaded bushing 17 and causes the end plate 15 to move and compress the barrel spring 14. This assembly provides for a continuously variable amount of stored energy. The stiffness of the spring may be designed to the preference of the owner.

The trigger release assembly consists of three important parts. A trigger release button 12 is inserted in the rear cue barrel and also in a release cylinder 13. A trigger release button spring 11 is under the trigger release button 12. The mechanism is shown in the locked position with spring force being applied to the trigger release button.

When the trigger release button 12 is pressed into the rear cue barrel 28, the contact 31 between the trigger release button 12 and the release cylinder 13 is removed and the release cylinder 13 then slides forward until the stop edge 20 prevents movement. The trigger release button 12 is machined to a shape that matches slots in the release cylinder 13 to allow the motion to occur. The trigger release button spring 11 helps to prevent unwanted activation of the pool cue by keeping the trigger release button 12 in the locked position until activated by the owner. It also provides for a convenient re-locking action on the trigger release button 12 when getting ready for the next pool shot.

A machined recess 40 on the release cylinder 13 provides support for the barrel spring 14 and optionally includes room for a washer to ensure a smooth turning for the barrel spring 14 when the spring compression is adjusted.

When the release cylinder 13 is allowed to slide forward, it then pushes the rear impact rod 19 forward. The rear impact rod 19 is firmly threaded into the release cylinder 13. The rear impact rod 19 is connected to a front impact rod 21 by a threaded connection 26. The front impact rod 21 is connected to a machined tip 23 which is attached by a pin 22 or other means. The machined tip 23 is then attached to an end impact tip 24 which will actually strike the billiard ball. The attachment design for the end impact tip 24 may be by glue, threading, press fit, or other mounting means. The end impact tip 24 may be a typical material used in pool cues as desired by the owner. The attachment may include the use of a knurled or threaded hole. Various designs may be used that allow a quick change.

The pool cue may be disassembled for storage by first unscrewing the front impact rod 21 and then unscrewing the front cue barrel 30. The rear impact rod 19 is prevented from rotating because the release cylinder 13 is prevented from rotating by the trigger release button 12.

The pool cue is reset for the next shot merely by pushing the impact rods and tip assembly back into the cue. The trigger release button spring 11 pushes the trigger release button 12 into the locked position and which holds the cue ready for the next shot.

Figure 2:
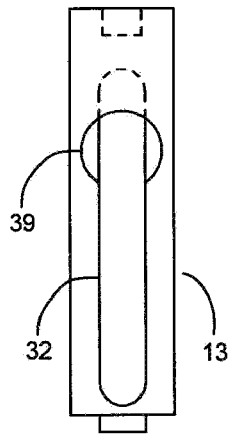
FIG. 2 is a detail of a release cylinder used in the activation mechanism.

FIG. 2 shows a detail of the release cylinder 13 in a view in the same direction as the release button motion. An enlarged eyehole 39 is designed to engage a larger diameter of the trigger release button 12 and provide a smaller diameter slot 32 that will slide past the trigger release button 12 when the invention is activated.

Figure 3:
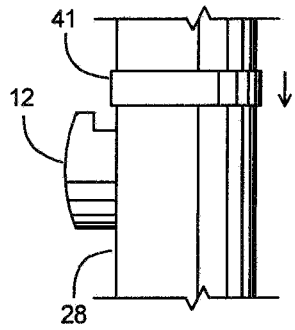
FIG. 3 is a detail of a retaining ring for the release button.

FIG. 3 shows an additional important detail that is omitted in FIG. 1. A machined aluminum retainer ring 41 is added to the outside diameter of the rear cue barrel 28. It slides over the length of the cue in the direction as illustrated to lock the trigger release button 12 inside the rear cue barrel 28 and prevent it from falling out. The retainer ring 41 has an outside diameter small enough to allow the trigger release button 12 only enough motion to perform its function and not spring out.

In general, the cue can be modified as per the desires of the owner. The overall design provides for the use of a variety of materials. Also the cue exterior may be modified by various paints, surface textures, anodizing, and knurling.

This invention lends itself very readily to the use by persons with handicaps or disabilities.

This invention may be adapted in length to fit for use by the preference or need of the owner.

This cue barrels have been designed, in a preferred embodiment, to be made by the use of standard machining techniques from an aluminum dowel or billet. This allows the customization of the cue to the length, surface texture, and appearance specified by an owner.

While various embodiments of the present invention have been described, the invention may be modified and adapted to various similar pool cues to those skilled in the art. Therefore, this invention is not limited to the description and figure shown herein, and includes all such embodiments, changes, and modifications that are encompassed by the scope of the claims.

The invention claimed is:

1. A spring activated pool cue designed to strike a billiard ball comprising:

a) a front barrel wherein said front barrel has a lengthwise internal opening of a first uniform diameter, b) a rear barrel wherein said rear barrel has a lengthwise internal opening of said first uniform diameter and a second uniform diameter, c) wherein said second uniform diameter is larger than said first uniform diameter and said second uniform diameter is located at the rear end of said rear barrel, d) a spring actuation assembly designed to fit inside said second uniform diameter comprising:

i) a threaded shaft which compresses an activation spring when said threaded shaft is rotated, ii) wherein said activation spring is pressed against a release cylinder, and iii) wherein said release cylinder is restricted to move parallel to the lengthwise direction of said rear barrel, e) wherein said threaded shaft protrudes out of the rear of said rear barrel and is connected to an adjusting knob which is fixed to said threaded shaft, f) an activation button designed to fit inside said release cylinder wherein said activation button restricts movement of said release cylinder when in a first position and allows said release cylinder to move when in a second position, g) wherein said activation button is restricted to move substantially perpendicular to the lengthwise direction of said rear barrel and said activation button prevents said release cylinder from rotating, h) wherein said activation button is positioned to protrude partially out of said rear barrel, i) wherein a reset spring provides a nominal force to push said activation button toward said first position, j) an impact rod which comprises a front section and a rear section wherein said rear section is connected to said release cylinder, k) wherein said impact rod is located substantially within said front barrel and said rear barrel, l) wherein a small portion of said front section protrudes outwardly from said front barrel and said small portion of said front section is rigidly connected to a tip, m) wherein said tip is designed to strike against said billiard ball and said tip optionally incorporates a removable end piece, n) wherein said front section and said rear section are connected together by a first threaded connection, o) wherein said front barrel and said rear barrel are connected together by a second threaded connection, and p) wherein said spring activated pool cue operates by moving said activation button from said first position to said second position.

2. The spring activated pool cue according to claim 1 wherein the outside diameter of said front barrel and the outside diameter of said rear barrel are machined to provide a partial taper.

3. The spring activated pool cue according to claim 1 wherein the outside diameter of said rear barrel incorporates a surface texture.

4. The spring activated pool cue according to claim 1 wherein the outside diameter of said front barrel and the outside diameter of said rear barrel incorporates an anodized finish or paint.

5. The spring activated pool cue according to claim 1 wherein a) said first uniform diameter is between ⅛ of an inch to 3/16 of an inch inclusive, b) said second uniform diameter is substantially ⅝ of an inch, c) said second uniform diameter is between 4 to 6 inches long inclusive inside said rear barrel, and d) said activation button is substantially ⅜ of an inch in diameter.

6. The spring activated pool cue according to claim 1 wherein the overall length of said spring activated pool cue is substantially 4 and ½ feet long.

7. The spring activated pool cue according to claim 1 wherein said front barrel, said rear barrel including said rear impact rod, and said front impact rod are each less than 2 and ½ feet long when said spring activated cue is disassembled at said first threaded connection and at said second threaded connection.

8. The spring activated pool cue according to claim 1 wherein said first uniform diameter and said second uniform diameter are created by a drilling operation and an optional machining operation.

* * * * *